United States Patent [19]

Stahlecker

[11] Patent Number: 4,660,372

[45] Date of Patent: Apr. 28, 1987

[54] DRIVING ARRANGEMENT FOR OPEN-END FRICTION SPINNING MACHINES

[75] Inventor: Fritz Stahlecker, Josef-Neidhart-Strasse 18, 7347 Bad Ueberkingen, Fed. Rep. of Germany

[73] Assignees: Fritz Stahlecker; Hans Stahlecker, both of Fed. Rep. of Germany

[21] Appl. No.: 684,867

[22] Filed: Dec. 21, 1984

[30] Foreign Application Priority Data

Dec. 24, 1983 [DE] Fed. Rep. of Germany ..... 3347087

[51] Int. Cl.[4] ..... D01H 7/882; D01H 13/16; F16H 7/14

[52] U.S. Cl. ..... 57/401; 57/81; 57/100; 57/105; 474/115

[58] Field of Search ..... 57/400, 401, 405, 81, 57/104, 105, 264, 5; 474/114, 115, 102

[56] References Cited

U.S. PATENT DOCUMENTS

| | | | |
|---|---|---|---|
| 2,201,233 | 5/1940 | Johnstone | 242/67.1 R |
| 2,341,992 | 2/1944 | Jarrett | 474/115 |
| 2,555,880 | 6/1951 | Fruechtel | 474/115 X |
| 2,601,431 | 6/1952 | Christie | 474/114 X |
| 2,791,126 | 5/1957 | Christopher | 474/114 X |
| 3,070,324 | 12/1962 | Bryman | 242/86.5 R |
| 3,461,660 | 8/1969 | Nimtz et al. | 57/115 |
| 3,875,691 | 4/1975 | Patterson | 474/115 X |
| 3,895,483 | 7/1975 | Grau | 57/405 X |
| 4,166,356 | 9/1979 | Chrtek et al. | 57/405 X |
| 4,222,225 | 9/1980 | Stahlecker et al. | 57/263 |
| 4,315,398 | 2/1982 | Parker et al. | 57/401 |
| 4,362,008 | 12/1982 | Parker et al. | 57/401 X |
| 4,514,973 | 5/1985 | Stahlecker | 57/401 X |
| 4,541,233 | 9/1985 | Raasch et al. | 57/401 X |

FOREIGN PATENT DOCUMENTS

| | | | |
|---|---|---|---|
| 2810184 | 9/1979 | Fed. Rep. of Germany . | |
| 996542 | 2/1983 | U.S.S.R. | 57/264 |

*Primary Examiner*—Stuart S. Levy
*Assistant Examiner*—Joseph J. Hail, III
*Attorney, Agent, or Firm*—Barnes & Thornburg

[57] ABSTRACT

An apparatus is disclosed for driving a pair of friction rollers arranged adjacent one another forming a wedge-shaped yarn-forming gap. A common drive belt is run along the surfaces of both rollers and the shaft of an electric motor. The motor is displaceably mounted in a guide which maintains the motor shaft in an essentially parallel relation to the friction roller shafts. The motor shaft can thereby be displaced for the purpose of increasing or decreasing the tension of the drive belt.

6 Claims, 2 Drawing Figures

DRIVING ARRANGEMENT FOR OPEN-END FRICTION SPINNING MACHINES

BACKGROUND AND SUMMARY OF THE INVENTION

This invention relates to an arrangement for open-end friction spinning wherein two rollers are arranged next to one another, form a wedge-shaped gap and are drivable in the same rotational direction by means of a joint driving belt that is looped around a pulley arranged on a shaft of an electric motor.

German DE-OS No. 28 10 184 discloses an arrangement wherein two rollers are mounted on shafts by means of roller bearings at each end of the shafts, and the shafts are provided with pulleys driven by a joint driving belt that is looped around a pulley of a stationary electric motor. In practice, this type of belt drive requires additional tensioning elements in order to ensure sufficient tension of the belt so that the two rollers are driven uniformly.

One of the objectives of the present invention is to provide an arrangement related to the previously mentioned type with a simplified construction and more operationally efficient drive.

This objective is achieved by running the driving belt along the surfaces of the rollers, and by mounting the electric motor in a guide in such a way that the motor is displaceable while maintaining the motor shaft in essentially parallel relation relative to the roller shafts.

By running the drive belt directly along the surfaces of the rollers, a significant simplification of the drive and of the bearings of the rollers is achieved because additional pulleys are not required. The surfaces of the rollers can be disposed on stationarily arranged shafts. The movable guide of the electric motor also makes it possible to tighten the driving belt in such a way that the correct tension of the belt can be adjusted without additional tightening or guiding means for the driving belt. This results in a drive with a very simple construction.

In a further development of the invention, the rollers and the electric motor are arranged at the vertices of a triangle. This results in a development which is advantageous with respect to space and ensures that both rollers and also the pulley of the electric motor are looped by the driving belt over a relatively large angle so that work can take place with a relatively low belt tension.

In a further development of the invention, the electric motor is mounted on a pivotal shaft that is parallel to the roller shafts. The result is a very simple guide means for the electric motor which ensures that the shaft of the electric motor may be displaced, but only in a manner maintaining the shaft parallel with respect to the roller shafts.

In a further development of the invention, the shaft of the electric motor is arranged outside a plane bisecting the wedge-shaped gap and closer to the roller following the electric motor in the running direction of the driving belt. Thus the circumstance is taken into account that the pulling end of the driving belt is loaded with a higher tensile force than the other end, whereas, the shafts of both rollers are loaded approximately equally.

In a further development of the invention, it is provided that the guide for the electric motor is mounted on a bearing support which also supports the shafts of the rollers. As a result, the rollers and their drive are combined into one structural unit. It is therefore possible to align the rollers and their drive including the electric motor precisely with one another without excessive cost.

In order to adjust the tension of the belt to a desired magnitude, in a further development of the invention the electric motor is loaded by one or more biasing means. The biasing means are designed taking into account the position in which the electric motor is installed. When the shafts of the rollers and shaft of the electric motor are horizontally arranged, the weight of the electric motor itself may suffice as a biasing force, and if necessary, may be partially alleviated by a spring. In the case of a vertical arrangement of the shafts of the rollers and of the shaft of the electric motor, a spring biasing means alone must produce the tension in the belt.

In a further development of the invention, the path of the electric motor in its guide is limited by one or several limit stops. This prevents uncontrolled displacement of the driving motor in the case of a breakage of the driving belt.

In a further development of the invention, devices are provided for switching off the electric motor which respond to a breakage of the driving belt and/or a fault detected in spun yarn. This prevents the driving motor or the rollers from being damaged in the case of a problem, whether it is a breakage of the driving belt or of the yarn.

In a further development of the invention, means are provided for adjusting the position of the driving motor in order to change the tension of the driving belt. In this case, it is particularly advantageous to provide means to increase the tension of the driving belt temporarily when the rollers are started during a yarn piecing process so that slippage of the driving belt over the cylindrical surfaces of the rollers decreases and a shorter acceleration time to operational angular velocities is reached.

In a further development of the invention, braking means are provided that can be applied to the surfaces of the rollers. Braking means of this type are especially advantageous for an automatic yarn piecing process.

In a further development of the invention, it is provided that means for changing the tension of the driving belt and braking means are coupled with one another in such a way that the tension of the driving belt is decreased when the braking means are actuated. This prevents the full driving capacity from being transferred to the rollers during braking so that the brakes as well as the drive are preserved.

In a further development of the invention, one or more roller bearings are disposed on the roller shafts under the surfaces of the rollers in the area where the driving belt and/or the braking means are applied. This ensures that the forces that are applied to the surfaces of the rollers from the outside are transferred as directly as possible into the bearings and shafts.

In a further development of the invention, the electric motor has an acceleration curve that rises at a flat angle and a braking curve that decreases at a flat angle. This development has the advantage that starting as well as stopping takes place relatively gently without any additional measures so that considerable slippage is avoided between the driving belt and the roller surfaces at the time of starting and at the time of stopping the rollers.

Further objects, advantages and novel features of the present invention will become more apparent from the following detailed description when considered in conjunction with the accompanying drawings which show, for purposes of illustration only, embodiments in accordance with the present invention.

DETAILED DESCRIPTION OF THE DRAWINGS

Figure 1:
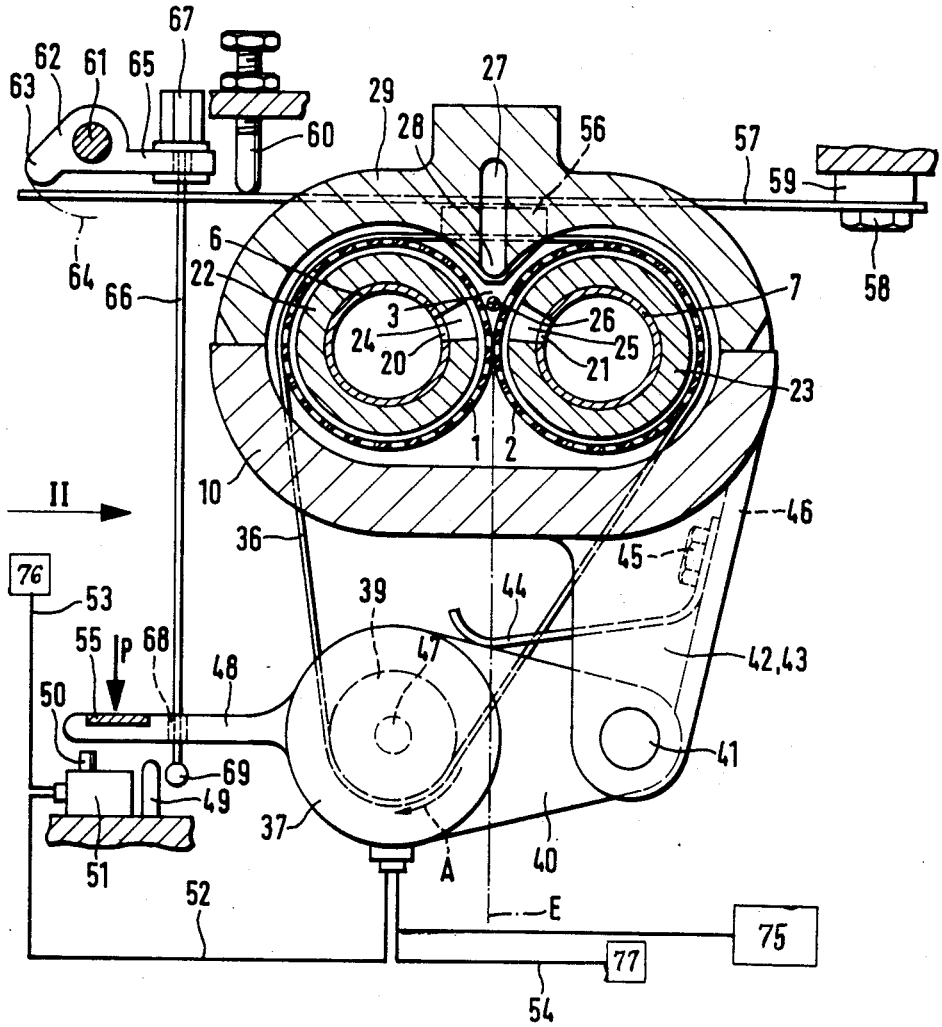
FIG. 1 is a partial cross sectional view of an arrangement for open-end friction spinning constructed in accordance with a preferred embodiment of the present invention.
Figure 2:
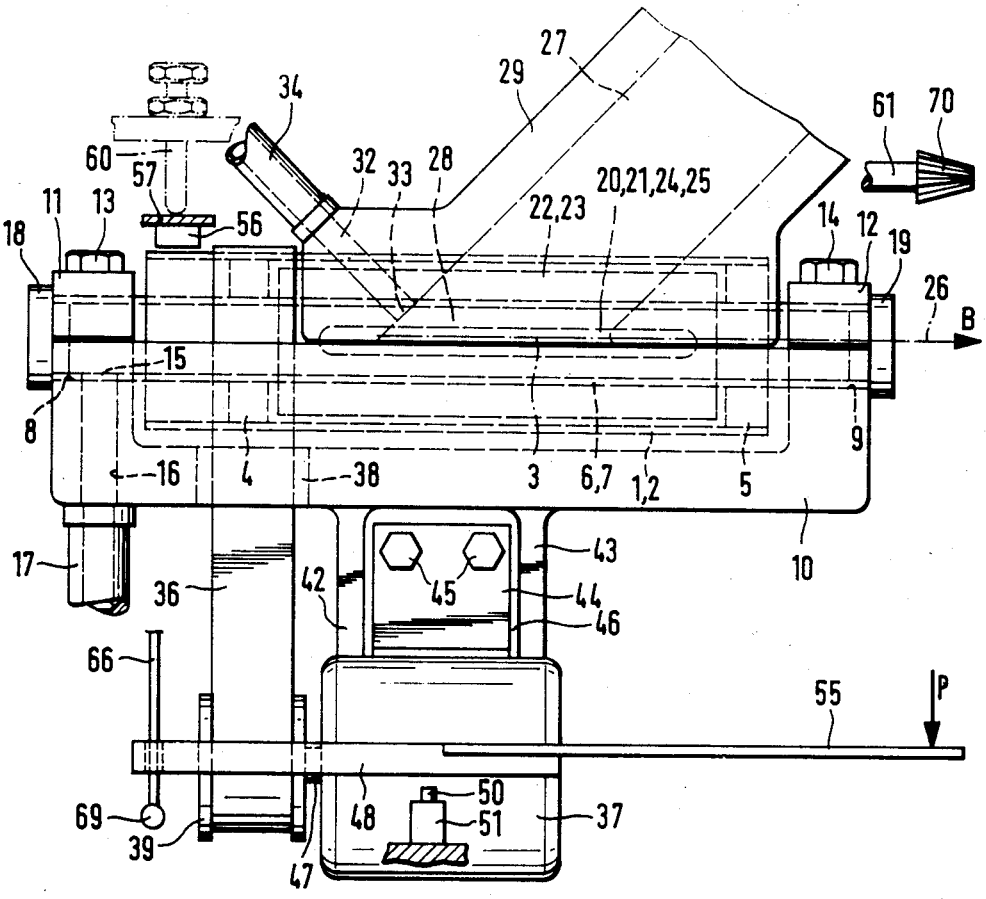
FIG. 2 is a side view of the arrangement according to FIG. 1 in the direction of the Arrow II.

The arrangement shown in FIG. 1 and 2 is designed as a component of an open-end friction spinning machine which consists of a plurality of identical arrangements of that type that are arranged in a row next to one another.

Also part of these arrangements is a feeding and opening device in which a sliver is opened up into individual fibers. Via a fiber feeding channel 27, these fibers are led into the region of a wedge-shaped gap 3 formed by two rollers 1 and 2 that are arranged in parallel adjacent one another. The formation of the yarn takes place in the wedge-shaped gap 3 between the rollers 1 and 2 which maintain a separation of a few hundredths of a millimeter. The forming yarn 26 is withdrawn from the wedge-shaped gap by a withdrawal device such as a pair of rollers. The yarn is subsequently wound onto a spool by suitable means.

The surfaces of the rollers 1 and 2 are cylindrical and the rollers are disposed on shafts 6 and 7 by means of roller bearings 4 and 5 at each end of the rollers. The shafts 6 and 7 are designed as tubes projecting out of each end of the rollers 1 and 2 and clamped into semicircular receiving means 8 and 9 of a bearing support 10 by means of tool holders 11 and 12. The tool holders 11 and 12, which also have semicircular recesses are fastened to the bearing support 10 by means of screws 13 and 14. The shafts 6 and 7, designed as tubes, are closed by plugs 18 and 19 at each end. In the region of one clamping point, the tube-shaped shafts 6 and 7 are provided with an opening 15 to which a bore 16 of the bearing support 10 connects. The bores 16 are connected to vacuum pipes 17 so that the tubular shafts 6 and 7 are subjected to a vacuum. The tubular shafts 6 and 7 each have a longitudinal slot 20 and 21 directed toward the wedge-shaped gap 3. Pipes 22 and 23 are fitted onto the shafts 6 and 7 and extend along the area between the roller bearings 4 and 5. A small separation is maintained between the outer surface of the pipes 22 and 23 and the interior surfaces of the rollers 1 and 2. The pipes 22 and 23 are provided with longitudinal slots 24 and 25 that correspond to the longitudinal slots 20 and 21 of the shafts 6 and 7. These slots 24 and 25 are also directed at the wedge-shaped gap 3. At least in the area of these longitudinal slots 20, 21 and 24, 25, the surfaces of the rollers 1 and 2 are provided with perforations so that an air current is produced in the vicinity of the wedge-shaped gap 3 that is directed toward the inside of the rollers. The fibers and the forming yarn 26 are held in the region of the wedge-shaped gap 3 by means of this air current. The slot-shaped fiber feeding channel 27 which is a component of a housing part 20 supported on the bearing support 10 is positioned in close proximity to the wedge-shaped gap 3, and its mouth 28 extends longitudinally along the wedge-shaped gap 3. As shown in FIG. 2, the fiber feeding channel 27 forms an acute angle with the yarn-withdrawal direction B. In the vicinity of the mouth 28 of the fiber feeding channel 27, a duct 32 is provided in the wall that extends in a direction opposite the yarn withdrawal direction B. Through this duct, an additional air current is produced in the mouth 28 of the fiber feeding channel 27, which is relatively weak in comparison to the air current produced via the hollow shafts 6 and 7. The additional air current has the purpose of aligning and stretching the fibers before they are deposited in the wedge-shaped gap 3 onto the surfaces of the rollers 1 and 2.

The housing part 29 extends axially from the wedge-shaped gap and opposite the withdrawal direction B of the yarn 26 away from the roller bearing 4. In the region of roller bearing 4, the driving of the rollers 1 and 2 takes place by means of a continuous driving belt 36 running directly against the roller surfaces and looped around a pulley 39 arranged on a shaft 47 of an electric motor 37. As shown in FIG. 1, the rollers 1 and 2 and the pulley 39 with its driving motor 37, are disposed at the vertices of a triangle so that the driving belt loops around the pulley 39 and the surfaces of the rollers 1 and 2 at relatively large angles. The electric motor 37, via its shaft 47, drives the pulley 39 in the direction of the Arrow A. The motor 37 is controlled by a control device 75 which causes the electric motor to accelerate and decelerate at a constant rate. Via the driving belt 36, the rollers 1 and 2 are therefore driven in such a way that the roller 1 rotates into the wedge-shaped gap 3 carrying the fibers, while the roller 2 turning in the same rotational direction rotates out of this wedge-shaped gap 3. The electric motor 37, the shaft 47 of which extends in parallel to the shafts 6 and 7 of the rollers 1 and 2, is displaceably supported in such a way that without additional elements, the tension of the driving belt 36 may be adjusted. In order to obtain a uniform bearing load for the rollers 1 and 2, the electric motor 37 is displaced, off-center with respect to the wedge-shaped gap plane E that bisects the wedge-shaped gap 3 and extends perpendicularly from the plane containing the shafts 6 and 7 in such a way that the pulley 39 is located closer to the roller 1. As a result, the circumstance is taken into account that the tension in the pulling end of the driving belt 36 leads to an increased load between the roller 2 and the pulley 39.

The housing of the electric motor 37 is provided with a swivel arm 40 disposed by means of a swivelling shaft 41. The swivelling shaft 41 extends in parallel to the shaft 47 of the electric motor and thus also in parallel to the shafts 6 and 7 of the rollers 1 and 2. Two support arms 42 and 43 are fastened at the bearing support 10 thereby supporting the swivelling shaft 41. On a plate 46 provided between the support arms 42 and 43, a leaf spring 44 is mounted by means of screws 45. The leaf spring 44 is biased against the swivel arm 40 which is integral with the housing of the electric motor 37. The leaf spring 44 is arranged in such a way that it biases the swivel arm 40 away from the rollers 1 and 2, so as to increase the tension on the driving belt 36. When the rollers 1 and 2 are aligned horizontally and the electric motor 37 is arranged beneath the rollers, the weight of the electric motor 37 alone may be sufficient for applying the appropriate tension to the driving belt 36. If necessary, it may even be necessary to reduce the tension on the belt by means of a supporting spring which partially alleviates the effect of the weight of the electric motor 37. When the rollers 1 and 2 are aligned vertically in their installed position, and thus the swivelling shaft 41 and the shaft 47 of the electric motor 37 are also aligned vertically, the tension required for the driving belt 36 is supplied exclusively by a spring corresponding to the leaf spring 44.

In order to limit the displacement of the electric motor 37 which occurs after a breakage of the driving belt 36, a stationary limit stop 49 is provided. This stationary limit stop 49 is located in the swivelling path of an arm 48 on the housing of the electric motor 37 opposite the swivel arm 40. A limit switch 51 is arranged adjacent the arm 48. The actuating means 50 of said limit switch 51 is actuated by a breakage of the driving belt shortly before the arm 48 contacts the stop 49. The limit switch 51 is connected to the electric motor 37 by a line 52. Another line 53 leads to an indicator light 76 which indicates a disturbance at the respective spinning unit. An electric line 54 also connects the electric motor 37 with a yarn guard 77. This yarn guard is arranged in the path of the moving yarn either in front of or behind the withdrawal device and responds to a breakage and/or an unacceptable change of the quality of the yarn by stopping the electric motor 37.

A leaf spring 55 is attached at the arm 48 of the electric motor 37 projecting toward the operating side of the spinning unit (in FIG. 2 on the right-hand side). This leaf spring 55 can be loaded when necessary with a force P applied by a movable servicing apparatus in order to temporarily increase the tension of the driving belt 36 in a desired manner. It is especially useful when it is desired to accelerate the rollers 1 and 2 from a stopped state to their operational rotational speed as quickly as possible. Slippage of the driving belt 36 during this phase can be excluded by increasing the tension on the belt.

For stopping the rollers 1 and 2, a wedge-shaped brake block 56 is provided. This block can be introduced into the area of the wedge-shaped gap 3 and can be applied to the surfaces of the rollers 1 and 2 in the area of the roller bearings 4. The rollers 1 and 2 extend beyond the roller bearings 4 next to the driving belt 36 which exits the bearing support 10 through opening 38. A leaf spring 57 integral with the block is fastened on one side to a holder 59 by means of screws 58. On the other side, it supports itself against a stationary stop 60 that is opposite the rollers 1 and 2. This leaf spring 57 is biased in such a way that the braking block 56 is lifted off the surfaces of the rollers 1 and 2. An actuating element 62 is associated with the leaf spring 57. This actuating element 62 is arranged on a rotatably disposed shaft 61. The actuating element 62 has a cam 63 which sweeps out an arc 64 when the shaft 61 is rotated, and thereby applies a force to the leaf spring 47 deforming it in such a way that the braking block 56 is applied to the surfaces of both rollers 1 and 2. The shaft 61 projects into the area of the operating side (FIG. 2, on the right-hand side) and at its end is provided with a pinion 70. Shaft 61 can be rotated by applying a complimentary rotating means mounted on an automatic servicing apparatus to the pinion. This servicing apparatus can be moved along a spinning machine to service a spinning unit in need of repair.

In order to prevent wear on the driving belt 36 during braking, the tension of the driving belt 36 is removed or at least reduced during actuation of the brake. For this purpose, the actuating element 62 is provided with a slave lever 65 to which a tension strip 66 is coupled by means of a fastening means 67. The tension strip is led through an opening 68 in the arm 48 of the electric motor 37 and provided at its end with a stop 69. By rotating the shaft 61 which extends in parallel to the swivelling shaft 41, the tension strip 66 is tightened in such a way that its stop 69 applies a force against the arm 48 and thus displaces the electric motor 37 in the direction of the rollers 1 and 2. The length of the tension strip 66 is such that the electric motor 37 can move so as to actuate the actuating means 50 of the limit switch 51 in the case of a breakage of the driving belt 36. In this case, the additional stop 49 may not be absolutely necessary.

From the preceding description of the preferred embodiments, it is evident that the objects of the invention are attained, and although the invention has been described and illustrated in detail, it is to be clearly understood that the same is by way of illustration and example only and not to be taken by way of limitation. The spirit and scope of the invention are to be limited only by the terms of the appended claims.

What is claimed is:

1. An open-end friction spinning apparatus comprising:

at least one spinning unit, said spinning unit comprising two friction rollers having cylindrical surfaces arranged adjacent one another forming a wedge-shaped yarn-forming gap therebetween, pulley means arranged on power-driven shaft means, said shaft means extending substantially parallel to said roller means, and joint driving belt means engaging said pulley means and said surfaces of said two friction rollers, said power-driven shaft means comprising a shaft mounted on an electric motor, said rollers and said power-driven shaft means being spatially arranged at the vertices of a triangle, said shaft means having an axis of rotation and said wedge-shaped gap being bisected by a bisecting plane substantially tangent to both said friction rollers, said axis of rotation being contained in a plane other than said bisecting plane, said power-driven shaft means being more closely disposed to a first roller of said two friction rollers receiving a belt directly from said pulley mounted on said shaft means than to a second roller receiving said belt directly from said first roller.

2. An open-end friction spinning apparatus comprising:

at least one spinning unit, said spinning unit comprising two friction rollers having cylindrical surfaces arranged adjacent one another forming a wedge-shaped yarn-forming gap therebetween, pulley means arranged on power-driven shaft means, said sahft means extending substantially parallel to said roller means, and joint driving belt means engaging said pulley means and said surfaces of said two friction rollers, and control means for shutting off a supply of power to said power-driven shaft means in response to breakage of said joint driving belt means, said control means comprising belt monitoring means in contact with said belt means for directly monitoring said belt means.

3. An apparatus according to claim 2, wherein said belt monitoring means comprises shaft movement monitoring means for monitoring movement of said power driven shaft means.

4. An open-end friction spinning apparatus comprising:

at least one spinning unit, said spinning unit comprising two friction rollers having cylindrical surfaces arranged adjacent one another forming a wedge-shaped yarn-forming gap therebetween, pulley means arranged on power-driven shaft means said sahft means extending substantially parallel to said roller means, and joint driving belt means engaging said pulley means and said surfaces of said two friction rollers, braking means for selectivley engaging said surfaces of said rollers, thereby preventing rotational movement of said rollers, and tension adjusting means for adjusting tension in said joint driving belt, said tension adjusting means being actuated in response to actuation of said braking means.

5. An open-end friction spinning apparatus comprising:

at least one spinning unit, said spinning unit comprising two friction rollers having cylindrical surfaces arranged adjacent one another forming a wedge-shaped yarn-forming gap therebetween, pulley means arranged on power-driven shaft means said shaft means extending substantially parallel to said roller means, and joint driving belt means engaging said pulley means and said surfaces of said two friction rollers, wherein said friction rollers comprise friction roller shaft means, at least one roller bearing means and surface shell means, at least one roller bearing means being disposed on said friction roller shaft means directly beneath a region of said surface shell means where said joint driving belt means engages said friction rollers.

6. An open-end friction spinning apparatus comprising:

at least one spinning unit, said spinning unit comprising two friction rollers having cylindrical surfaces arranged adjacent one another forming a wedge-shaped yarn-forming gap therebetween, pulley means arranged on power-driven shaft means said shaft means extending substantially parallel to said roller means, joint driving belt means engaging said pulley means and said surfaces of said two friction rollers; and braking means for selectively engaging said surfaces of said rollers, thereby preventing rotational movement of said rollers, wherein said friction rollers further comprise roller shaft means, at least one roller bearing means and surface shell means, at least one said roller bearing means being disposed in said shaft means beneath a region of said surface shell means where said joint driving belt means engages said friction rollers.

* * * * *